US010519014B2

(12) United States Patent
Conway

(10) Patent No.: US 10,519,014 B2
(45) Date of Patent: Dec. 31, 2019

(54) SAFETY BARRIER FOR LOADING DOCK LIFT

(71) Applicant: Mezzanine Safeti-Gates, Inc., Essex, MA (US)

(72) Inventor: Christopher J Conway, Wilmot, NH (US)

(73) Assignee: Mezzanine Safeti-Gates, Inc., Essex, MA (US)

( * ) Notice: Subject to any disclaimer, the term of this patent is extended or adjusted under 35 U.S.C. 154(b) by 254 days.

(21) Appl. No.: 15/638,446

(22) Filed: Jun. 30, 2017

(65) Prior Publication Data

US 2019/0002260 A1 Jan. 3, 2019

(51) Int. Cl.

| | |
|---|---|
| ***E05D 7/06*** | (2006.01) |
| ***B66F 17/00*** | (2006.01) |
| ***B66F 11/04*** | (2006.01) |
| ***B66F 9/02*** | (2006.01) |
| *B66F 9/00* | (2006.01) |

(52) U.S. Cl.

CPC ..... *B66F 17/006* (2013.01); *B66F 9/02* (2013.01); *B66F 11/04* (2013.01); *B66F 9/00* (2013.01); *B66F 17/00* (2013.01)

(58) Field of Classification Search

CPC ..... B66F 17/006; B66F 11/00; B66F 11/04; B66F 9/00

USPC ..... 49/236–239

See application file for complete search history.

(56) References Cited

U.S. PATENT DOCUMENTS

| | | | | |
|---|---|---|---|---|
| 2,799,103 A * | 7/1957 | Warren | E05F 13/04 | 119/524 |
| 4,041,646 A * | 8/1977 | Mittag | E06B 11/02 | 182/112 |
| 4,150,510 A * | 4/1979 | Harrison | E06B 11/00 | 49/388 |
| 4,422,264 A | 12/1983 | Harris | | |
| 4,538,379 A * | 9/1985 | Vargo | E06B 11/00 | 49/381 |
| 5,133,152 A * | 7/1992 | Grancagnolo | E05D 11/04 | 16/312 |

(Continued)

FOREIGN PATENT DOCUMENTS

| | | |
|---|---|---|
| CA | 2435120 A1 | 1/2004 |
| CN | 204386133 U | 6/2015 |

(Continued)

*Primary Examiner* — Jerry E Redman

(74) *Attorney, Agent, or Firm* — Antoinette G. Giugliano; Antoinette G. Giugliano PC

(57) ABSTRACT

The safety barrier is for a lift platform that moves between a bottom position and an upper position and safety barrier includes a gate, defining a first plane. The gate includes a surface adapted to engage a cam assembly. The safety barrier has a mount that mounts to the lift platform and a mounting pin, defining an axis, that rotatably mounts the gate. The safety barrier also includes an upright post assembly having an upright post mounted to a non-movable surface, and the cam assembly that applies an upward force to the surface of the gate. When the lift platform moves to the bottom position, the assembly engages the surface and the gate rotates about the axis in the first plane into an open position, and when the lift platform moves to the upper position, the gate rotates about the axis in the first plane into a closed position.

14 Claims, 11 Drawing Sheets

(56) References Cited

U.S. PATENT DOCUMENTS

| | | | | |
|---|---|---|---|---|
| 5,241,789 | A | 9/1993 | Vacelet | |
| 5,459,963 | A | 10/1995 | Alexander | |
| 5,546,703 | A | 8/1996 | Conway | |
| 5,701,701 | A | 12/1997 | Desrosiers | |
| 6,343,703 | B1 | 2/2002 | Fleagle et al. | |
| 6,412,220 | B1 | 7/2002 | Lindley | |
| 6,601,677 | B1 | 8/2003 | Storm | |
| 6,792,716 | B1 | 9/2004 | Luster | |
| 6,837,296 | B2 | 1/2005 | Kimener | |
| 7,552,683 | B2 | 6/2009 | Hayashi | |
| 7,854,092 | B2 * | 12/2010 | Stoffels | E06B 11/00 49/104 |
| 8,016,074 | B2 | 9/2011 | Black et al. | |
| 8,280,145 | B2 | 10/2012 | Kovarik et al. | |
| 8,341,888 | B2 * | 1/2013 | Stull | E05F 15/614 49/237 |
| 8,562,279 | B2 | 10/2013 | Beck et al. | |
| 8,651,236 | B2 | 2/2014 | Bowden | |
| 8,750,594 | B2 | 6/2014 | Kovarik et al. | |
| 8,813,909 | B2 | 8/2014 | Bowden | |
| 9,090,199 | B2 | 7/2015 | Gunby | |
| 9,149,670 | B1 | 10/2015 | Walker et al. | |
| 9,360,093 | B2 | 6/2016 | Garner | |
| 9,409,755 | B2 | 8/2016 | Melton et al. | |
| 9,504,260 | B2 | 11/2016 | Walz | |
| 9,527,387 | B2 | 12/2016 | Barrass | |
| 9,556,673 | B2 | 1/2017 | Stover et al. | |
| 9,581,285 | B2 | 2/2017 | Ergun et al. | |
| 9,616,796 | B2 | 4/2017 | Russo et al. | |
| 9,630,823 | B1 | 4/2017 | Conway | |
| 10,011,470 | B2 * | 7/2018 | Conway | B66F 17/006 |
| 2004/0156705 | A1 | 8/2004 | Ablabutyan | |
| 2004/0164288 | A1 * | 8/2004 | Williamson | B65G 1/02 256/73 |
| 2005/0005522 | A1 | 1/2005 | Benko | |
| 2008/0307709 | A1 * | 12/2008 | Stull | E05D 15/54 49/280 |
| 2010/0059466 | A1 * | 3/2010 | Tanner | A47B 51/00 211/134 |
| 2011/0072811 | A1 | 3/2011 | Bark | |
| 2011/0180349 | A1 * | 7/2011 | Beji | B66F 11/04 182/148 |
| 2012/0011774 | A1 | 1/2012 | Arnaud | |
| 2013/0075203 | A1 * | 3/2013 | Sayles | B66F 17/006 187/390 |
| 2013/0186710 | A1 | 7/2013 | Moss et al. | |
| 2014/0079517 | A1 | 3/2014 | Ablabutyan | |
| 2015/0027808 | A1 | 1/2015 | Baillargeon et al. | |
| 2015/0071749 | A1 | 3/2015 | Hambardzumyan et al. | |
| 2015/0217670 | A1 | 8/2015 | Ablabutyan et al. | |
| 2015/0368079 | A1 | 12/2015 | Scholfield et al. | |
| 2016/0097208 | A1 | 4/2016 | Stover et al. | |
| 2016/0098910 | A1 | 4/2016 | Cummings | |
| 2016/0221812 | A1 * | 8/2016 | Puszkiewicz | B66F 11/044 |
| 2017/0008535 | A1 | 1/2017 | Romero | |
| 2017/0267507 | A1 * | 9/2017 | Frame | B66F 17/006 |
| 2018/0282142 | A1 * | 10/2018 | Toler | B66F 7/065 |

FOREIGN PATENT DOCUMENTS

| | | | |
|---|---|---|---|
| CN | 205708983 | U | 11/2016 |
| DE | 202011005420 | U1 | 6/2011 |
| EP | 1291314 | A2 | 3/2003 |
| EP | 1012104 | B1 | 11/2005 |
| EP | 1396468 | B1 | 8/2007 |
| EP | 1999056 | B1 | 6/2012 |
| ES | 2260120 | T3 | 11/2006 |
| JP | 2017007591 | A | 1/2017 |
| WO | WO2006067448 | A1 | 6/2006 |
| WO | WO2006113779 | A1 | 10/2006 |
| WO | WO2016083848 | A1 | 6/2016 |

* cited by examiner

SAFETY BARRIER FOR LOADING DOCK LIFT

BACKGROUND OF THE INVENTION

Loading dock lifts have a variety of applications involving the transfer of cargo between an elevated truck bed and a depot floor. A typical loading dock lift includes a lift platform and apparatus for moving the lift platform between an upper position aligned with a truck bed and a lower position in which the lift platform is aligned with the depot floor (e.g., non-movable floor). Cargo transfers during loading and unloading operations from the truck occur at a first side (e.g., the truck side) of the lift platform which is closely adjacent to or aligned (e.g., coplanar alignment) with the truck bed when the lift platform is in the upper position. When the lift platform is at a lowered position, cargo can be transferred between the depot floor and the lift platform at a second side (e.g., the depot side) of the lift platform, the side opposite from the truck side.

Generally speaking a lift platform is useful in elevating cargo from the depot floor to an upper level corresponding to a truck bed level to facilitate the transfer of freight onto the truck bed. That is, when freight is to be loaded onto a truck, the freight is transferred onto the lift platform over the depot side at the ground or factory floor level. Then the lift platform and any cargo loaded on the lift platform elevates until the lift platform comes into an essentially coplanar alignment with the truck bed whereby cargo can transfer to the truck bed past the lift platform at the truck side.

During an off-loading operation, an empty lift platform elevates to be in an essentially vertical alignment with the truck bed whereupon cargo can be moved from the truck bed onto the elevated lift platform past the truck side. Then the lift platform lowers to the factory floor level whereupon the cargo can be moved from the lift platform to the depot floor at the depot side of the lift platform.

Personnel may ride on a loading dock lift during movement of the lift platform. Consequently it is important that such loading dock lifts minimize the possibility of a person's sustaining an injury by making a misstep and possibly falling from the lift platform in an elevated position.

A need exists for safety barriers that close when the lift platform is in the upper position. A further need exists for the safety barrier to open and close automatically when the lift platform moves between the bottom position and the upper position, respectively.

SUMMARY OF THE INVENTION

The present invention relates to a safety barrier for a lift platform. The safety barrier automatically moves from an open to a closed position, and vice versa, as the lift platform moves between bottom and upper positions. In particular, the safety barrier includes a gate that has at least one or more members e.g., to define a frame and/or one or more crossbars, and a surface adapted to engage a cam assembly. The gate defines a first plane and when the gate is in use, it opens and closes in this plane. In an embodiment, the gate can have at least a first member and a second member extending between at least a first crossbar and a second crossbar, wherein the first member and the second member are essentially parallel.

The safety barrier further includes a mount that mounts to the lift platform, wherein the mount has a mounting pin that rotatably mounts the gate. The mounting pin defines an axis and the gate rotates about the axis in the first plane (e.g., the plane of the gate). In an embodiment, the mounting pin is rotatably mounted to the one or more members or the one or more crossbars of the gate. In a certain aspect, the gate rotates about the axis, defined by the mounting pin, in a first direction in the first plane and in a second direction in the first plane, wherein the second direction is opposite the first direction. In an embodiment, the mount has an upper portion and a lower portion; and the upper portion includes the mounting pin, the lower portion of the mount is secured to the lift platform, and the mounting pin rotatably mounts the gate to the upper portion of the mount.

The safety barrier also includes an upright post assembly having an upright post mounted to a non-movable surface (e.g., the ground or floor), and a cam assembly that applies an upward force to the surface of the gate. The cam assembly can include, for example, a cam pin and the cam or roller. In an embodiment, the upright post has an upper end and a lower end, and the upper end of the upright post is configured to receive the cam assembly and the lower end of the upright post is mounted to the non-movable or fixed surface such as the floor or ground.

When the lift platform moves to the bottom position, the assembly (e.g., cam assembly) engages the surface (e.g., cam surface) and the gate rotates e.g., in a first direction, about the axis in the first plane into an open position, and wherein when the lift platform moves to the upper position, the assembly engages the surface and the gate rotates e.g., in a second direction, about the axis in the first plane into a closed position, as the lift platform is moved between said bottom position and said upper position. In an embodiment, the linear motion exerted by the cam assembly onto the surface translates into rotational motion of the gate. During rotation of the gate, for example, the cam assembly engages the surface along the length of the surface. The mounting pin is mounted, in one aspect, to allow the gate to rotate in the first plane that transects a second plane defined by the surface. In an embodiment, the mounting pin is rotatably mounted to the gate at the first crossbar, the second crossbar, the first member or the second member. Additionally, the safety barrier can optionally include a spring having a first end attached to the mount and a second end attached to the gate.

In addition to the safety barrier described herein, the present invention also relates to systems and kits having the parts or items of the safety barrier, as well as methods of using the safety barrier. In particular, the present invention includes methods of using the safety barrier, as described herein, for a lift platform that moves between a bottom position and an upper position. Using the safety barrier described herein the method, in an embodiment, includes moving the lift platform to the bottom position or the upper position to thereby allow the gate to move to the opened position or the closed position, respectively. In particular, the method includes raising the lift platform to the upper position to thereby allow the gate move to the closed position or lowering the lift platform to the bottom position to thereby allow the gate move to the opened position.

A safety barrier kit or system of the present invention includes one or more of the items described herein for the safety barrier. The kit or system includes the gate that defines a first plane, and has at least one or more members, wherein the gate, when in use, opens and closes in the first plane; and a surface adapted to engage a cam assembly. The kit or system also includes the mount. The mount is attached to the lift platform, wherein the mount has a mounting pin that rotatably mounts the gate; wherein the mounting pin defines an axis and the gate rotates about the axis in the first plane.

In addition, the present invention has an upright post assembly having an upright post mounted to a non-movable surface, and the cam assembly applies an upward force to the surface of the gate. Wherein, when installed, and the lift platform moves to the bottom position, the assembly engages the surface and the gate rotates about the axis in the first plane into an open position, and when the lift platform moves to the upper position, the assembly engages the surface and the gate rotates about the axis in the first plane into a closed position, as the lift platform is moved between said bottom position and said upper position. The safety barrier kit or system can further include a spring for attachment to the mount and to the gate.

The advantages of the present invention are numerous. The present invention allows for automatic opening and closing of the gate as the platform lift moves between the bottom position and the upper position. The automation of the opening and closing of the gate saves workers time and allows more cargo to be loaded or unloaded more efficiently. More importantly, since the opening and closing of the gate happens automatically, it will increase safety and reduce human error by the workers (e.g., forgetting to close a gate when the lift is in the upper position). Since the present invention saves time and reduces injury, it also provides an economic benefit to the company that uses the safety barrier.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 1A provides a front view of the safety barrier, the lift platform and the fixed platform. FIG. 1B shows a perspective view of the safety barrier, the lift platform and the fixed platform, while FIG. 1C provides a side view of the same.

FIG. 2A provides a front view of the safety barrier, the lift platform and the fixed platform. FIG. 2B shows a perspective view of the safety barrier, the lift platform and the fixed platform, while FIG. 2C provides a side view of the same.

FIG. 3A provides a front view of the safety barrier, the lift platform and the fixed platform. FIG. 3B shows a perspective view of the safety barrier, the lift platform and the fixed platform, while FIG. 3C provides a side view of the same.

DETAILED DESCRIPTION OF THE INVENTION

A description of preferred embodiments of the invention follows.

Figure 1B:
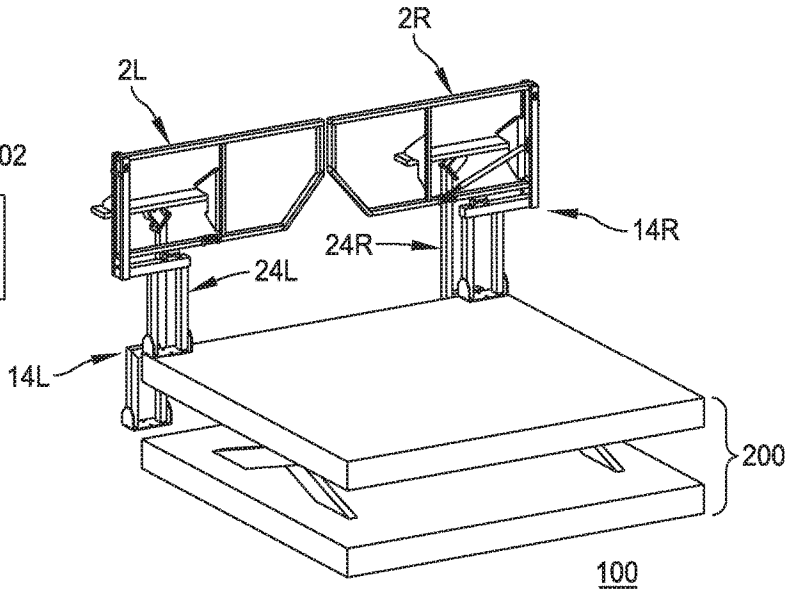
FIG. 1A, 1B, 1C are schematic drawings showing the safety barrier of the present invention in a closed position and the lift platform in an upper position.
Figure 1A:
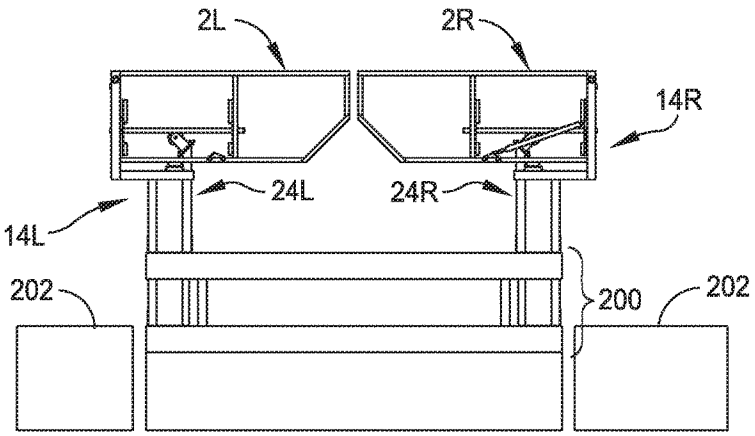
Figure 2B:
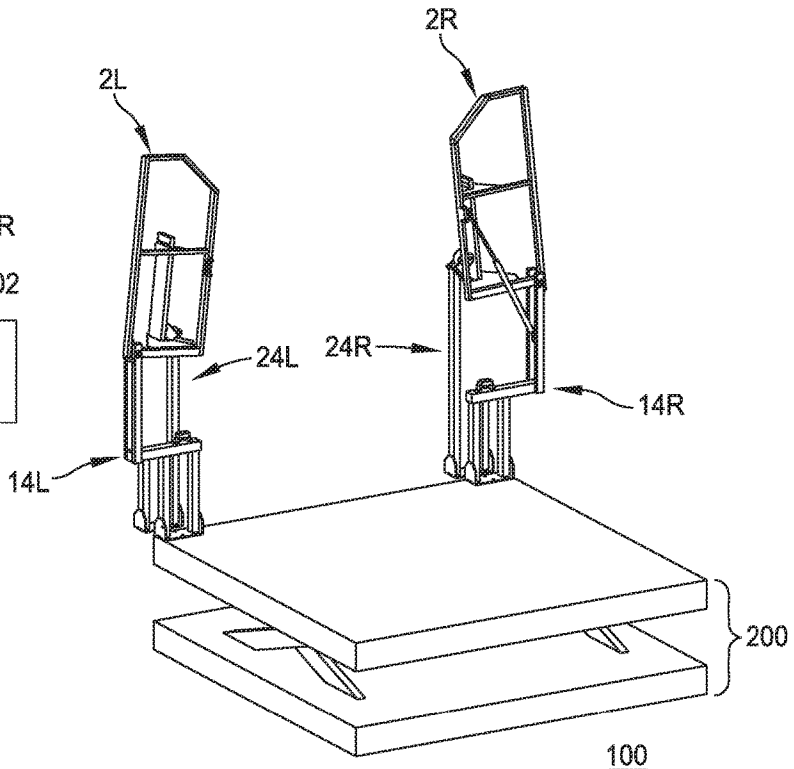
FIG. 2A, 2B, 2C are schematic drawings showing the safety barrier of the present invention in an open position and the lift platform in a lowered position in which the lift platform is level with that of the fixed platform.
Figure 2A:
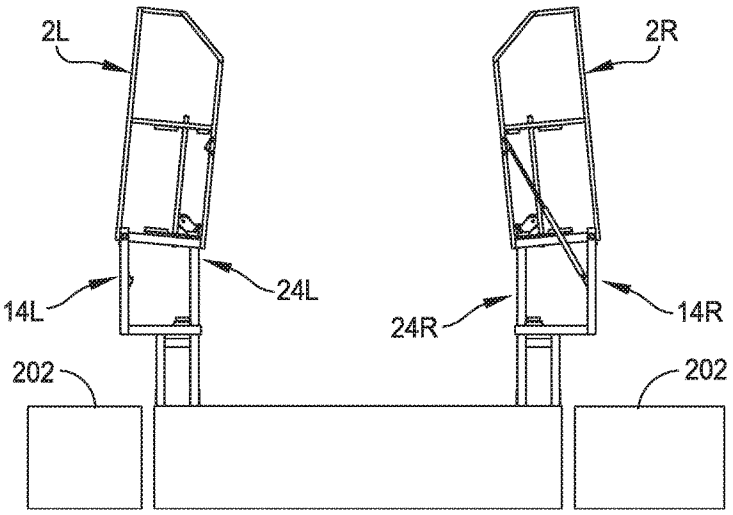
Figure 2C:
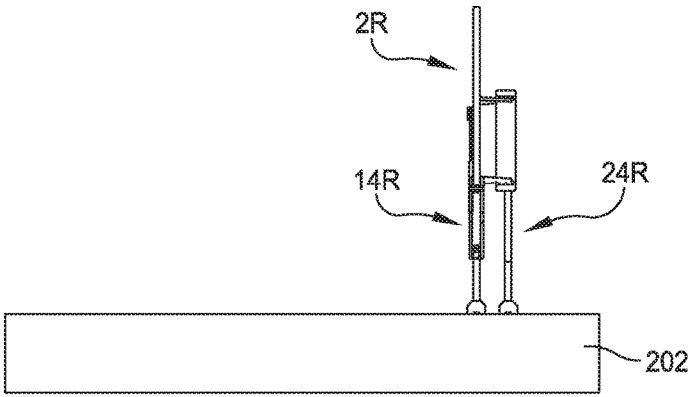
Figure 3B:
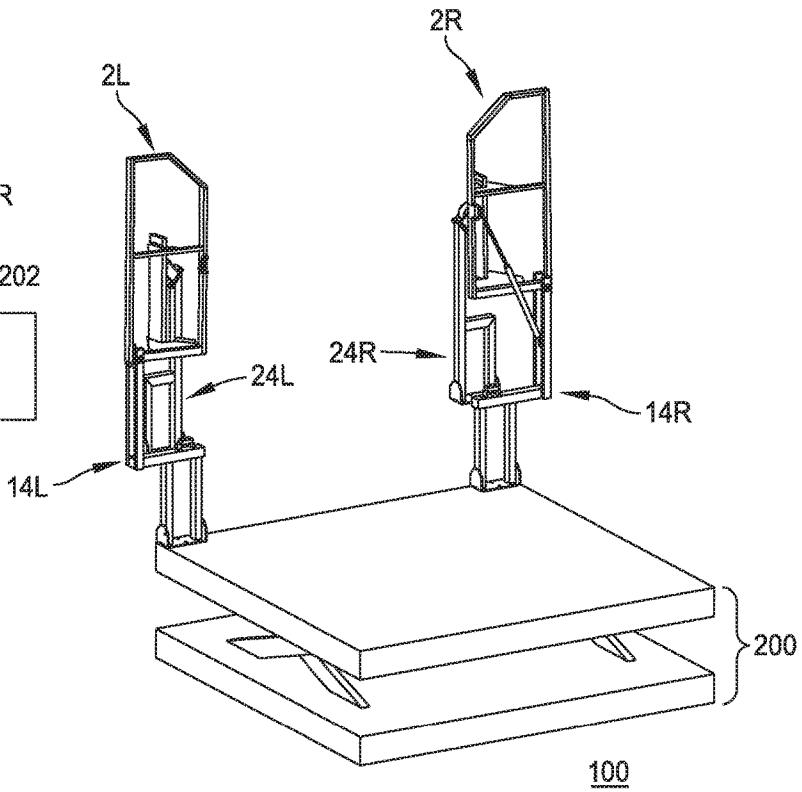
FIG. 3A, 3B, 3C are schematic drawings showing the safety barrier of the present invention in an open position and the lift platform in a lowered position in which the lift platform is at a level below that of the fixed platform.
Figure 3A:
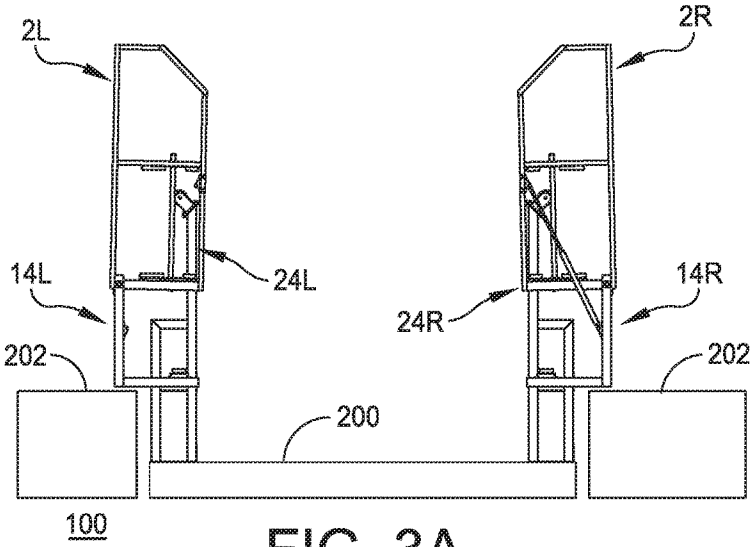
Figure 3C:
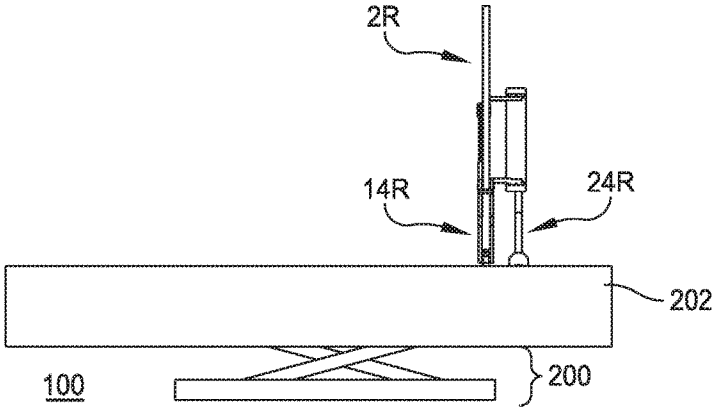

FIGS. 1-3 depict safety barrier 100 when it is in a closed position (i.e., when lift platform is elevated or in the upper position which is when the lift platform is above the fixed platform (FIG. 1)), or in the opened position (i.e., when lift platform is in the bottom position which is when the lift platform is level with the fixed platform (FIG. 2) or when the lift platform is below the fixed platform (FIG. 3)). The design of the safety barrier allows the gate to open and close automatically as a lift platform moves between the upper position and the bottom position. The present invention includes a barrier assembly that applies an upward force (e.g., a linear motion) to the gate as the lift platform moves between the upper position and the lower position, and the upward force, in turn, allows for the gate to rotate closed or opened.

In particular, when comparing FIGS. 1 and 2, FIG. 1 shows gates 2R and 2L in the closed position when lift platform 200 is elevated or in the upper position while FIG. 2 shows gates 2R and 2L in the open position when lift platform 200 is in a bottom position, in this case level with the fixed platform 202. FIG. 3 shows gates 2R and 2L also in the open position when lift platform 200 is in a bottom position, in this case below fixed platform 202. The upper position is defined herein as the position of the lift platform when the lift platform is at a height above that of the fixed platform. Specifically, in an embodiment, the height of the lift platform is a height that aligns with or is coplanar with a cargo bed of a vehicle (e.g., a truck) so that it can be loaded or unloaded. The bottom position of the lift platform is defined when the position of the platform lift is level to or below that of the fixed platform. As the gate rotates between open and closed positions, the gate or the frame members of the gate define a plane and the gate rotates upward or downward in that plane. Specifically, gates 2R and 2L are mounted to mount 14R and 14L, respectively, that has a lower portion attached to lift platform 200. The mount includes an arm or extension, at the upper portion of the mount that has a mounting pin that rotatably mounts the gate. The mounting pin defines an axis and allows the gate to rotate about the axis in the plane.

The gate of the present invention also includes a surface (also referred to as a cam surface) adapted to engage an upward force during movement of the lift platform. This surface defines a second plane that transects the plane in which the gate opens and closes. The cam surface slides or rolls over the upward post having a cam assembly, providing the upward force/linear motion, as the lift platform is lowered or raised, and allows the gate to rotate open or close. Put another way, the linear motion exerted by the cam onto the cam surface translates into rotational motion of the gate. The cam assembly engages the cam surface along the length of the cam surface as the cam surface slides or rolls across the cam assembly. The upward force is applied in a plane that is parallel or in line with the plane in which the gate opens and closes. The upward force is created by upright post assemblies 24R and 24L and their lower portions are mounted to the fixed platform (e.g., floor or ground) and remain relatively fixed as the gate and lift platform move.

The upper portion of the upright post has a cam assembly, such as a cam or roller (e.g., roller ball) that engages the cam surface of the gate. The phrases "cam assembly" and "cam" are used interchangeably herein and both are meant to include one or more cams and/or rollers. The cam assembly can further include a cam pin or similar devices to hold the cam or roller in place. As the lift platform moves to the bottom position and as the gate and the mount moves along with the lift platform, an upward force is applied by the upward post assembly (e.g., the upward post secured to the fixed platform and the cam or roller ball assembly) to the cam surface of the gate. The cam surface slides along as the upward force of the cam assembly is applied, and the gate rotates upward about the axis of the mounting pin. As the lift platform moves to the upper position, the cam surface moves along the upper portion of the upright post in the opposite direction and allows the gate to move to a closed position. The cam surface of the gate moves along the roller ball or cam applying an upward force and acts as a sort of a fulcrum. In an embodiment, the weight of the gate assists the gate to move to the closed position. Additionally, a spring can optionally be used to assist the gate in moving between open and closed positions or used to prevent the gate from "banging" closed.

Figure 4A:
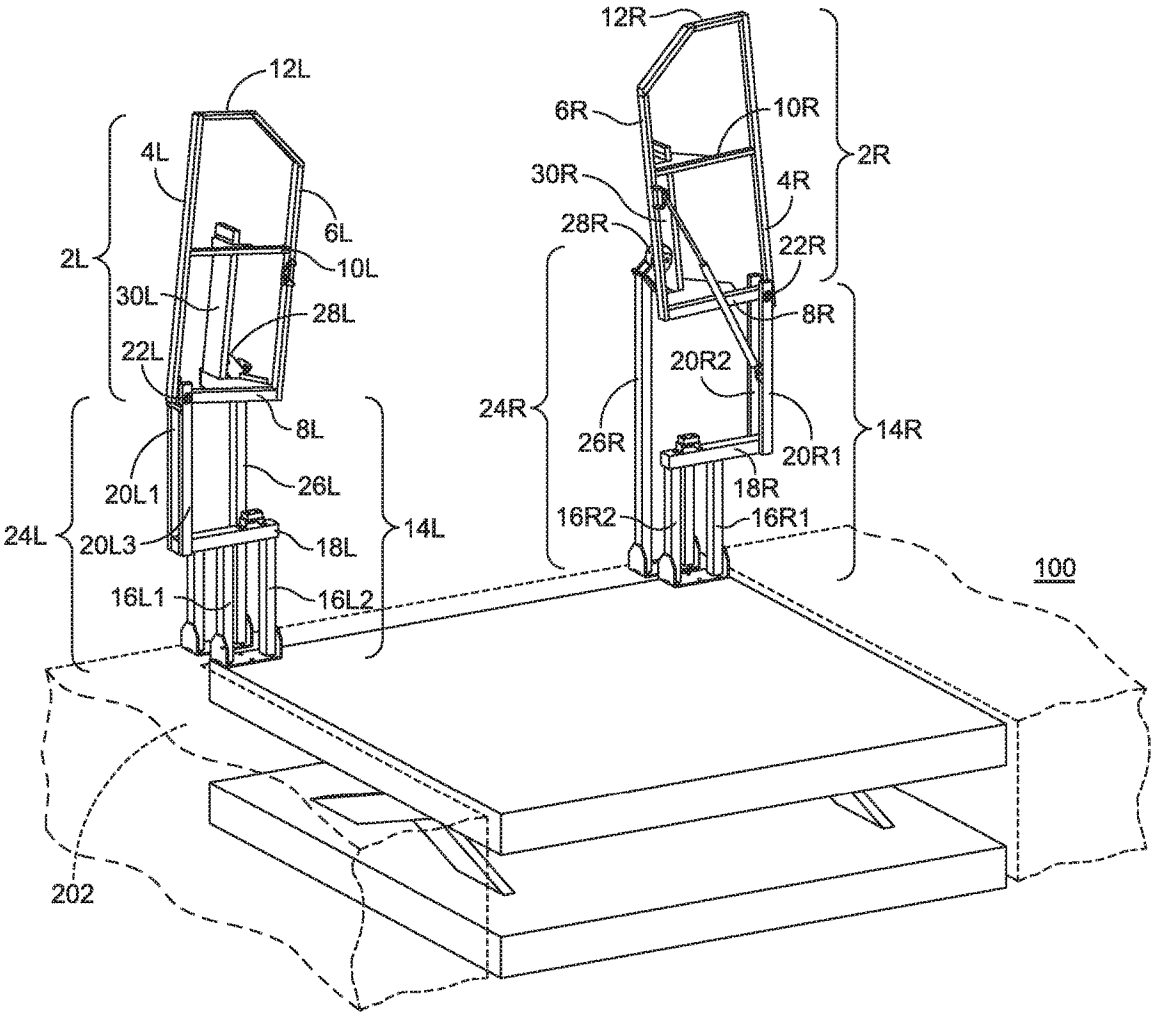
FIG. 4A is a schematic showing a perspective view of the safety barrier of the present invention in the open position.
Figure 4B:
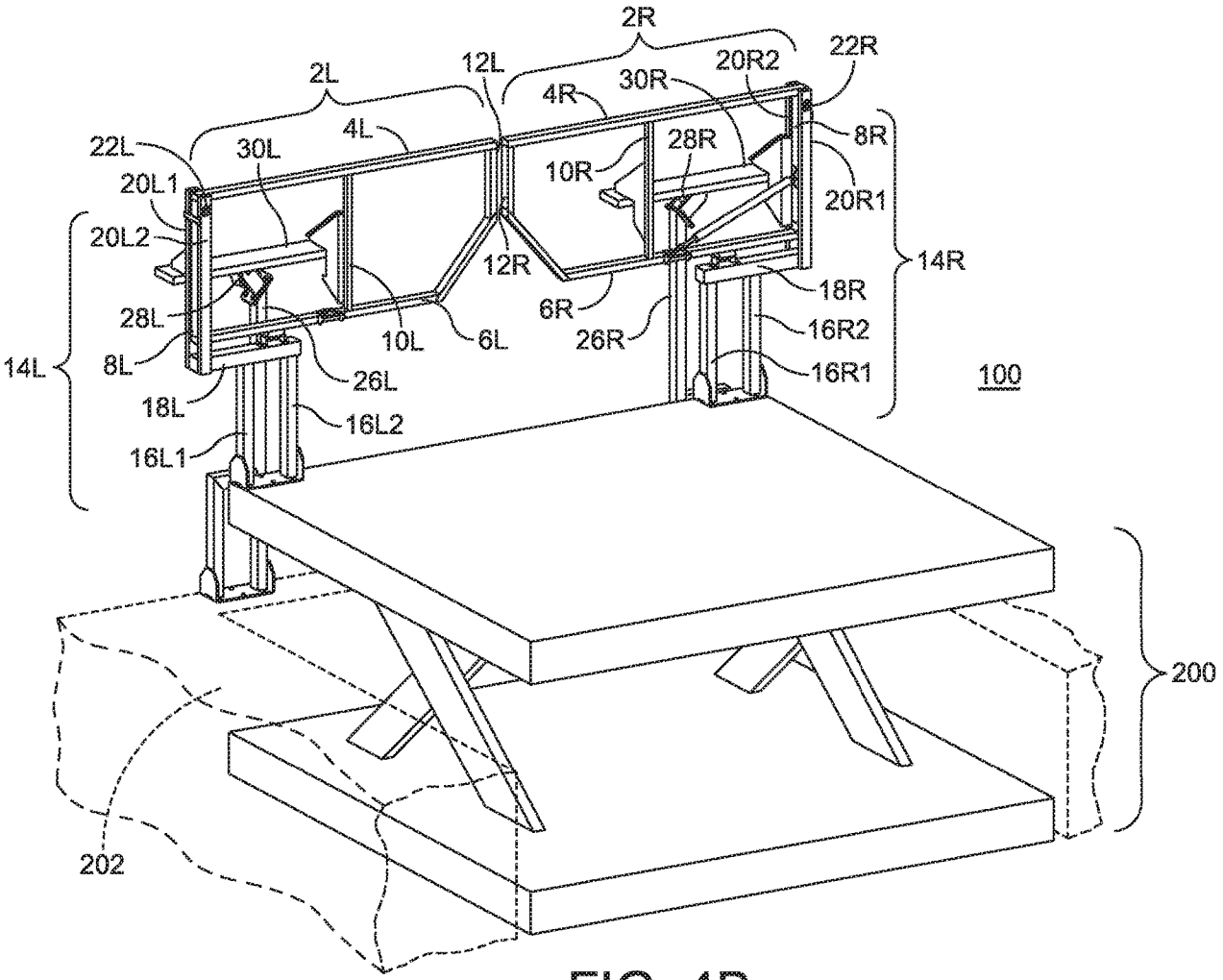
FIG. 4B is a schematic showing a perspective view of the safety barrier of the present invention in the closed position.

Referring to FIGS. 4A and 4B, safety barrier 100 is shown in more detail in a perspective view with gates 2R and 2L in open and closed positions. In the following description it will be helpful to define a loading dock lift as having "front," "back," "left" and "right" sides. In the following description some corresponding components have the same reference numbers; however the letters "L" and "R" distinguish the components associated with the left and right safety gates, respectively. For FIG. 2A shows gates 2R and 2L in the open position (when the platform lift is in the bottom position) and FIG. 2B shows gates 2R and 2L in the closed position (when the platform lift is in the upper position). Although the figures show two sets of gates being used, the present invention also includes the use of a single gate (e.g., one or more safety gate assemblies). A barrier assembly includes the gate, rotatably attached to the mount, and an upright post assembly. In the case of a single gate, the gate is longer to create a barrier along the back of the lift platform. In the case of two gates, both gates, when in the closed position, create a safety barrier along the front of the lift platform. In an embodiment, the barrier created by two gates does not need to be a continuous barrier when the gates are closed, but they are close enough to prevent a person from falling between them. Gate 2R has first member 4R and second member 6R, and crossbars 8R, 10R, and 12R and Gate 2L is its mirror image having first member 4L and second member 6L, and crossbars 8L, 10L, and 12L. The first and second members define a plane in which the gate rotates to open or close. The gate can have one or more members (e.g., one, two, three or four) or be a door having a solid plane. The members, crossbars and any frame member can be configured in any way (parallel, perpendicular, transect or irregularly shaped) with respect to one another. The members and crossbars can be of any configuration so long as they create a barrier.

Gates 2R and 2L further include cam surface 30R and 30L to receive the cam or roller ball assembly 28R or 28L, respectively. In an aspect, the cam surface has a plane that transects (e.g., perpendicular) to the plane of the gate. In the figures, cam surfaces 30R and 30L are attached to and offset from crossbars 8R and 10R, and crossbars 8L and 10L, respectively. The cam surface may optionally be coated to reduce friction as the cam surface engages cam or roller ball assembly to allow for the cam or roller ball assembly to more easily slide along the surface. The surface can be a track, guide or similar mechanism that allows the cam or roller ball assembly to slide as the gate is moving between closed and opened positions.

Gates 2R and 2L are rotatably mounted to mounts 14R and 14L, respectively. Mount 14R has securing members 16R1 and 16R2, and mount 14L has securing members 16L1 and 16L2, for attachment to lift platform 200. Mounts 14R and 14L have offset bars 18R and 18L and arms 20R1, 20R2 and 20L1 and 20L2, respectively. For example, arms 20R1 and 20R2 have an upper end that is adapted to receive mounting pin 22R. Mounting pins 22R and 22L attach to first members 4R and 4L, respectively, of the gates 2R and 2L. The mounting pin can be attached to any portion of the gate so long as the point of attachment allows for rotation of the gate in its plane between open and closed positions. For example, the point of attachment of the mounting pin can be along the one or more members, along the crossbar, or even on an offset plate, or support attached the gate. The mounting pin creates an axis about which the gate rotates between an open position (e.g., in a first direction) and a closed position (e.g., in a second direction that is opposite the first direction). The mounting pin can be any mechanism that allows for the gate to be rotatably mounted and allows rotation in the plane of the gate. For example, in place of the pin, a mounting rotational device can be used, such as concentric cylindrical joint, swivel, or other hinge.

Figure 1C:
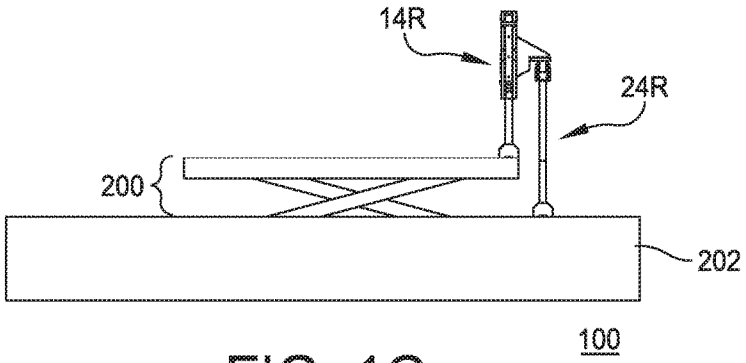
Figure 5A:
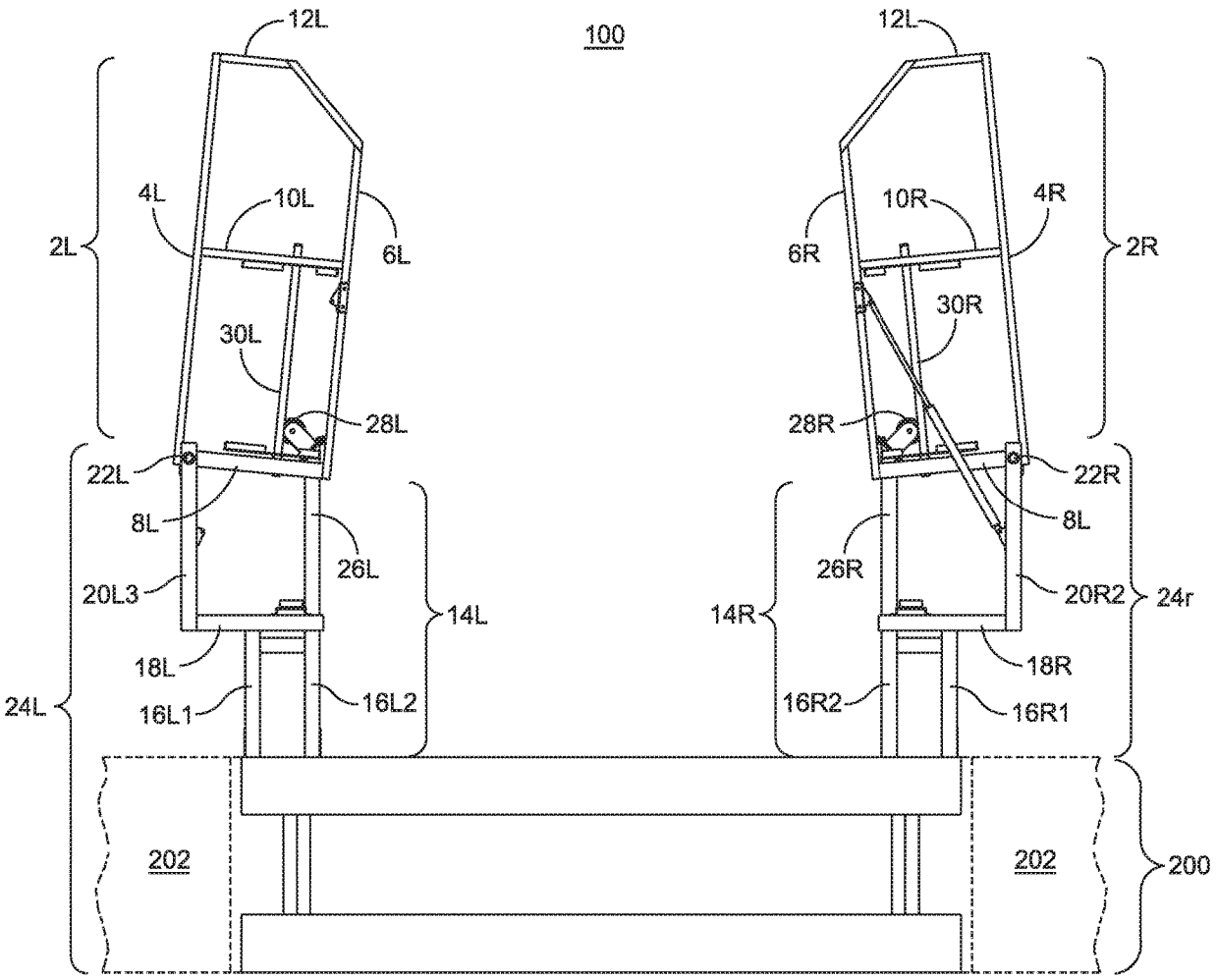
FIG. 5A is a schematic showing a front view of the safety barrier of the present invention in the open position.
Figure 5B:
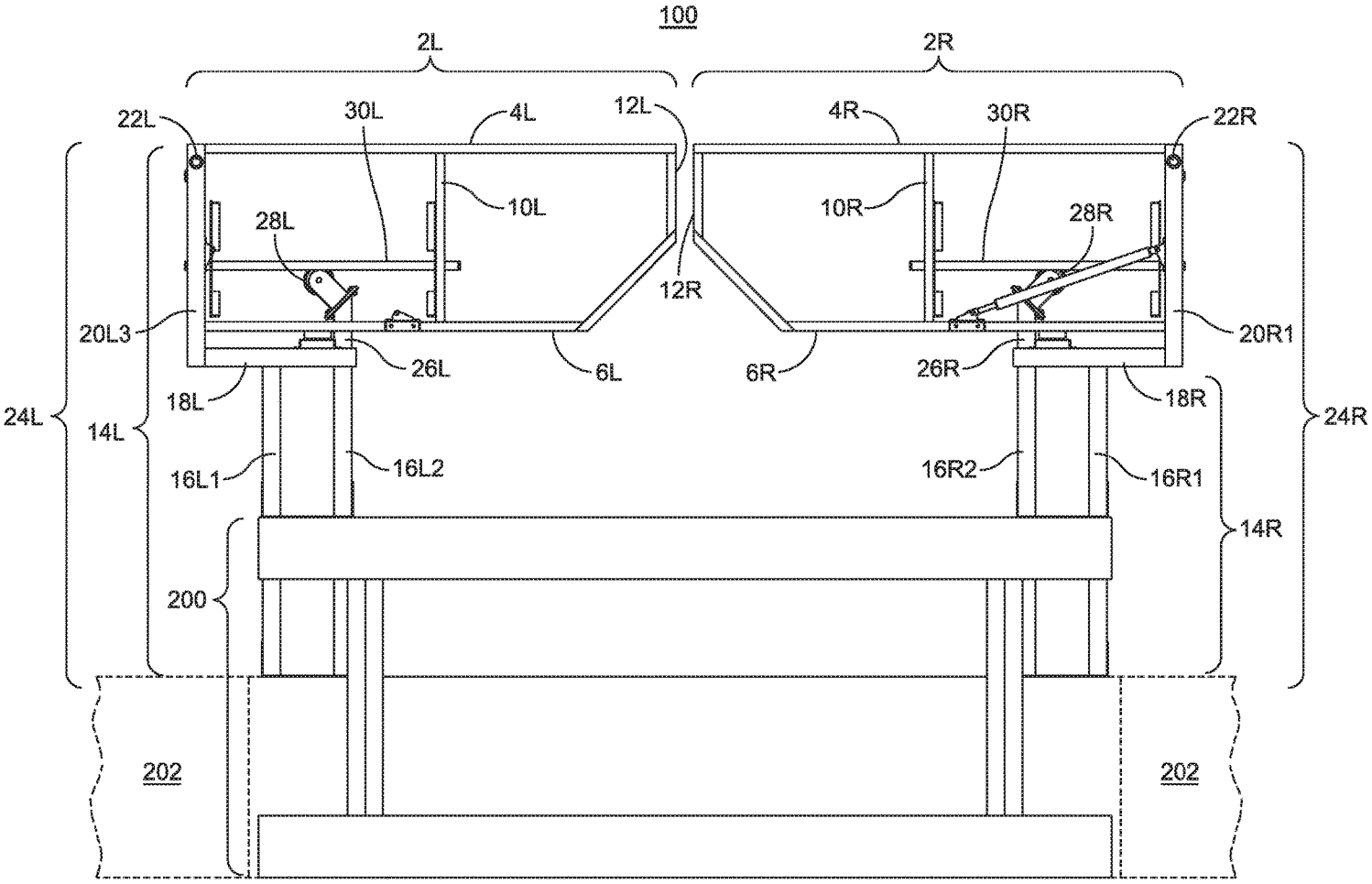
FIG. 5B is a schematic showing a front view of the safety barrier of the present invention in the closed position.

Safety barrier 100 of the present invention further includes upright post assemblies 24R and 24L (shown better in FIGS. 5A and 5B, a front view showing the gates in open and closed positions). The bottom portion of upright posts 26R and 26L is secured to a fixed platform (e.g., ground, floor, or other non-moveable surface). The upper end of the upright post has a cam or roller ball assembly 28R and 28L that applies an upward force along the cam surfaces 30R and 30L, respectively. The cam or roller assembly is one that allows the upward force to be translated into a rotational force. In an embodiment, the cam or roller assembly can be any device that allows for the upward force to be translated allowing the cam surface to slide across the upward post. In an embodiment, the cam or roller assembly allows for the reduced frictional movement of the cam surface and can be a cam or roller ball. The cam, roller or similar device can be any shape (e.g., round, oval, irregular) so long as it allows for reduced friction and allows the cam surface to slide/roll across the upward post. In the case of a roller, the cam rolls along the cam surface and in the case of a fixed cam member, the cam would slide along the cam surface. The idea is to reduce friction and provide a better motion. As the upward force is applied, the cam surface 30R slides across cam or roller ball assembly 28R. The force is generated by the differences in height between the upright post assembly 24R, secured to fixed platform 202, and mount 14R, secured to the moving lift platform 200 (See FIG. 1C). In an embodiment, upright post assembly 24R and mount 14R are offset relative to one another. In FIG. 1C the height of the mount, attached to the gate, is higher than the height of the upright post assembly. As the lift platform moves to the upper position, the weight of the gate applies a downward force as the upright post applies an upward force, acting as a fulcrum, during which the cam surface engages the cam or roller ball assembly to cause the gate to rotate closed. Similarly, as the lift platform is lowered so that the fixed platform and the lift platform are at the same level or the lift platform is below the fixed platform (e.g., in a bottom position), the difference in relative height between upright post assembly 24R and mount 14R is reduced, and the upward force of the upright post is applied and translates to the cam surface via cam/roller ball assembly, to cause the gate to rotate open (See FIGS. 1C and 2C).

FIGS. 5A and 5B show the front view of the safety barrier of the present invention in the opened and closed positions respectively. From this front view, one can see the position of the cam/roller ball assembly along the cam surface and the mounting pin about which the gate rotates. One can also observe that in the open position, the difference in heights between the mount and the upright post and levels of the lift platform and fixed platform are about the same, and in the closed position a greater difference in height between the mount and upright post. Furthermore, as seen from FIGS. 5A and 5B, the upright post assembly is offset as compared to the mount. Even though the upright post assembly is mounted to the fixed platform and the mount is mounted to the moving lift platform, in an embodiment, they are mounted offset from one another and not in line with one another. In an aspect of the invention, the upright post assembly is offset, as compared to the mount which is rotatably attached to the gate.

Figure 6A:
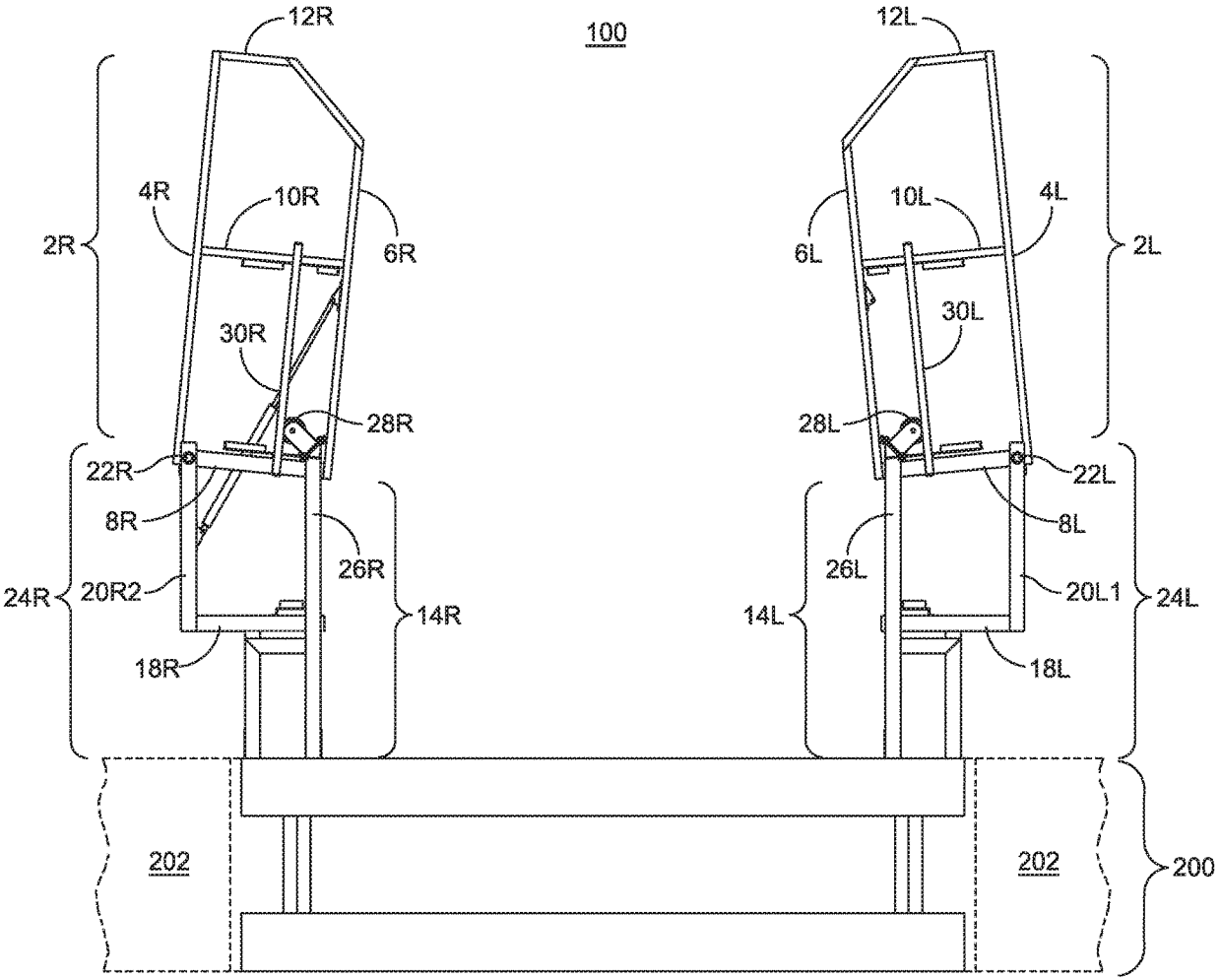
FIG. 6A is a schematic showing a back view of the safety barrier of the present invention in the open position.
Figure 6B:
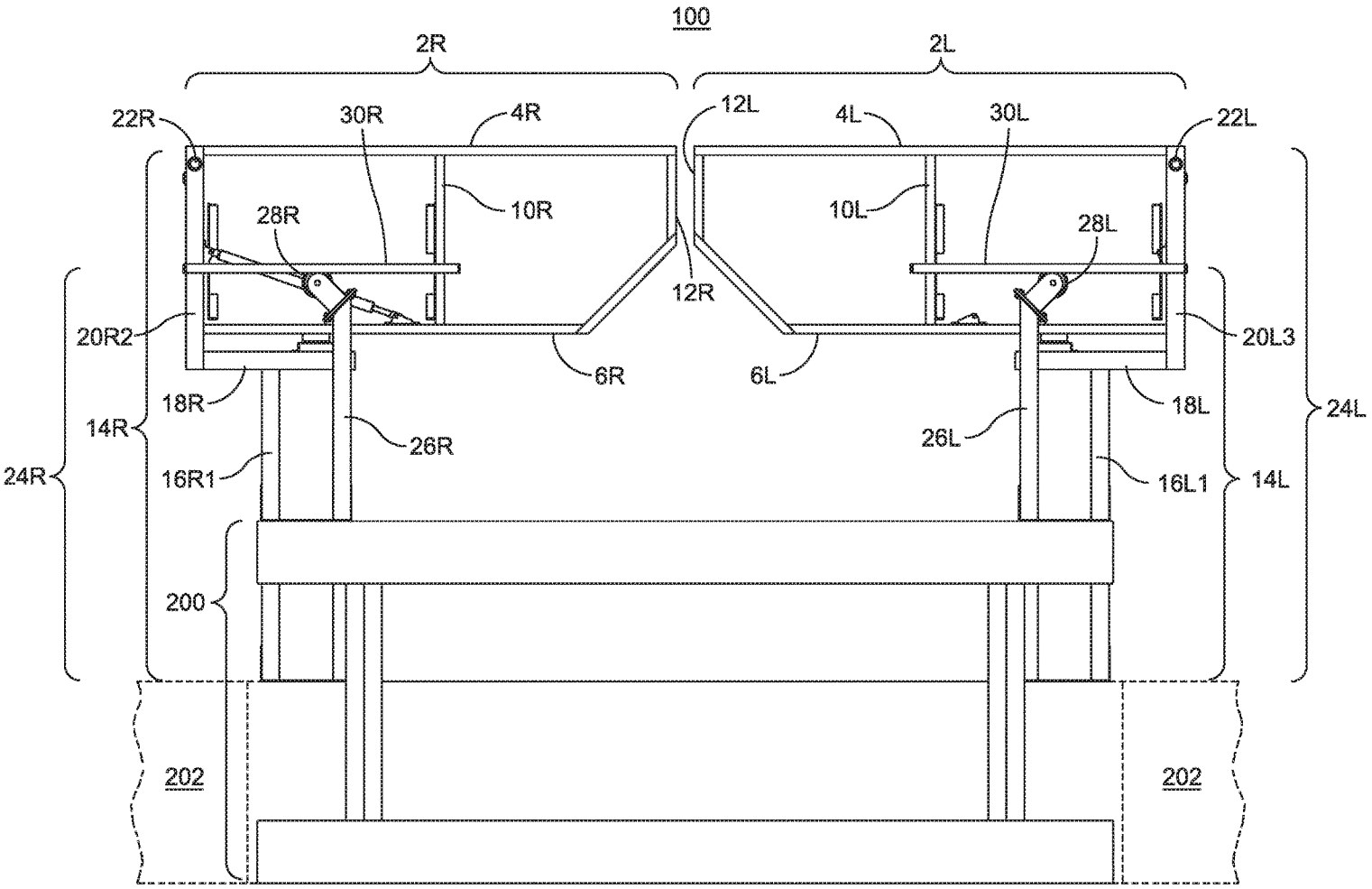
FIG. 6B is a schematic showing a back view of the safety barrier of the present invention in the closed position.
Figure 7A:
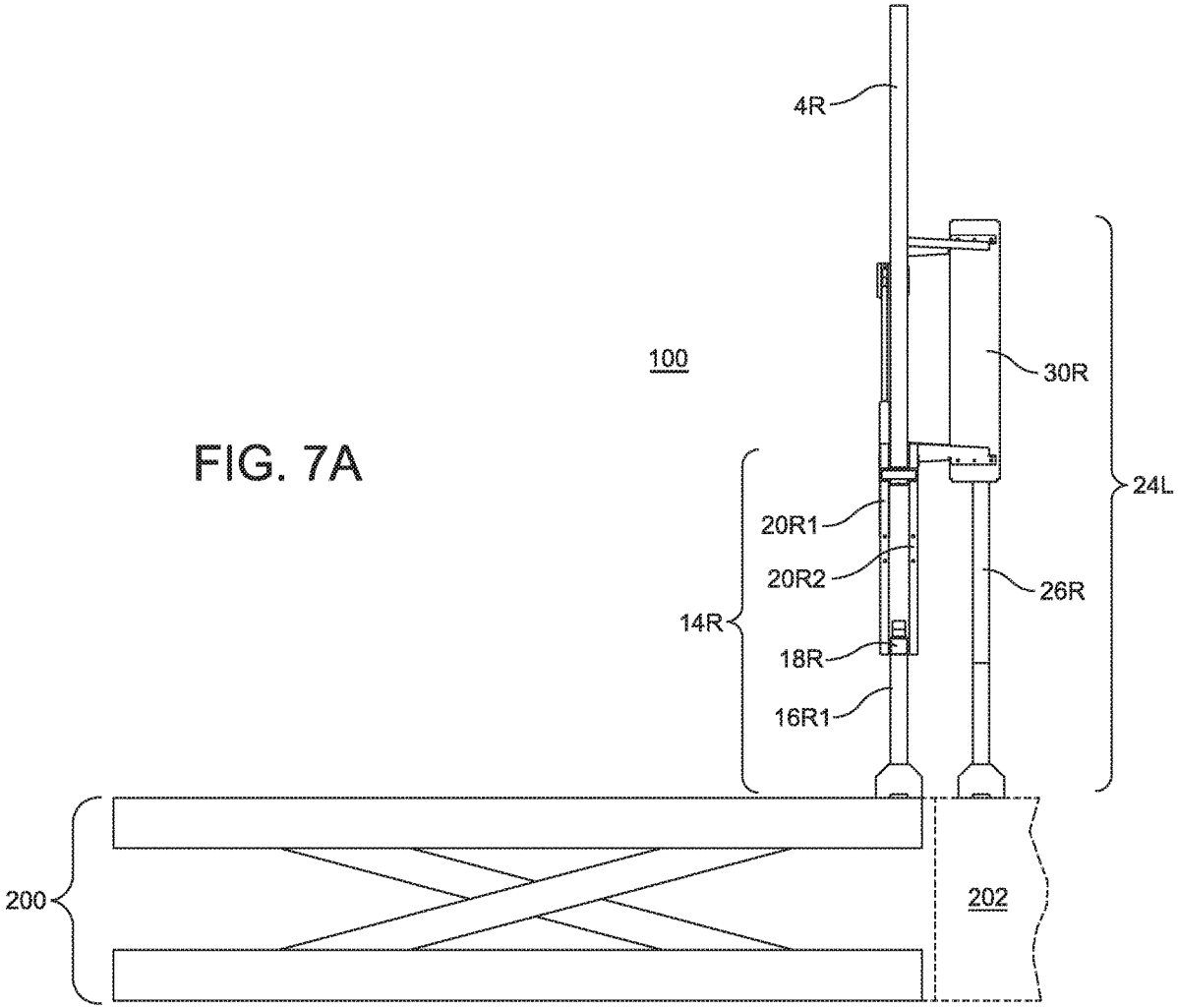
FIG. 7A is a schematic showing a side view of the safety barrier of the present invention in the open position.
Figure 7B:
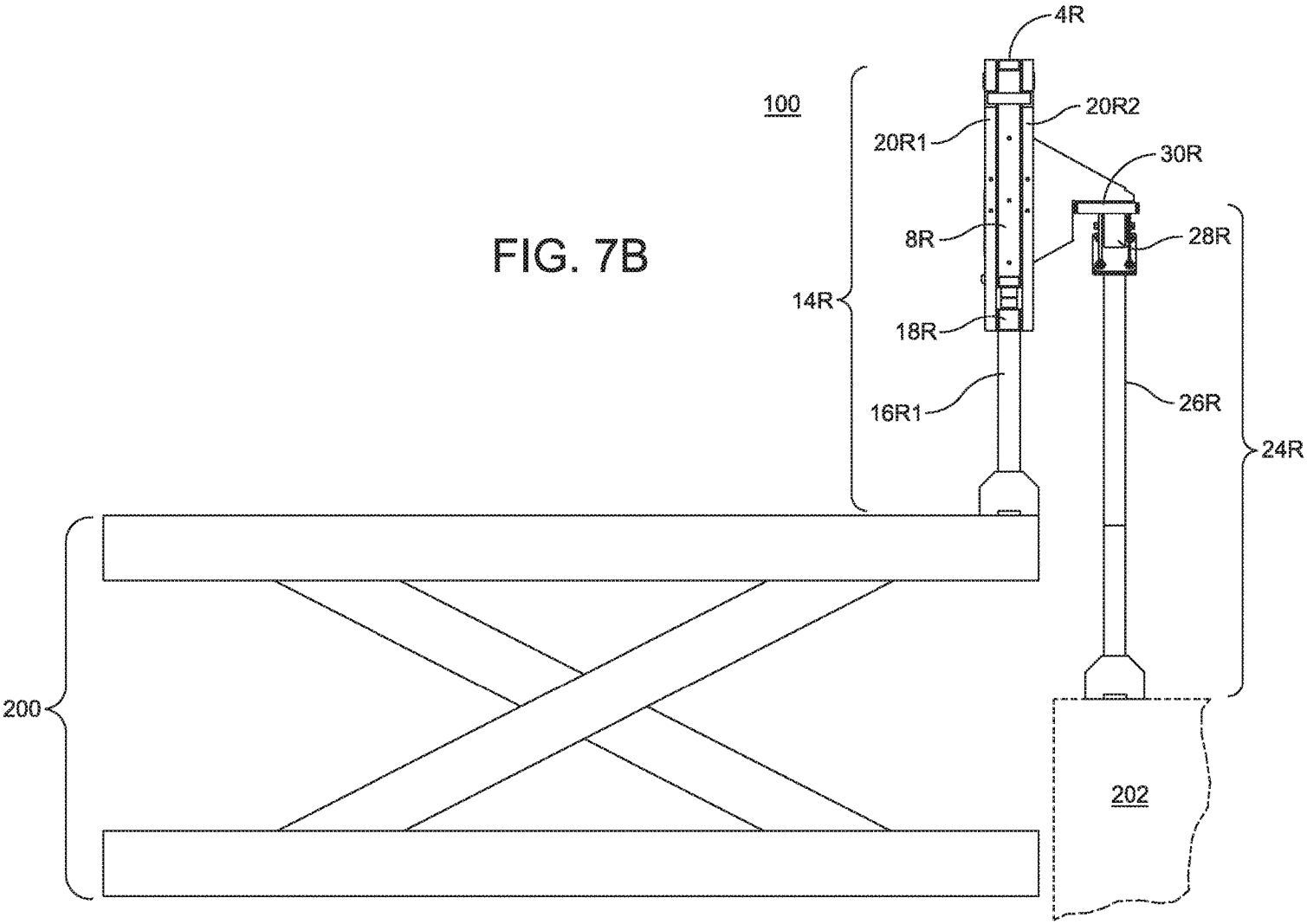
FIG. 7B is a schematic showing a side view of the safety barrier of the present invention in the closed position.

The back view shown in FIGS. 6A and 6B better shows the cam or roller ball assembly engaging the cam surface attached to the gate. Again, the differences in the location of the lift and fixed platforms can be observed, and the relative offset positions of the mount and upright posts. Similarly, FIGS. 7A and 7B show a side view of the gates in the open and closed positions. The offset of the cam surface from the gate is better seen in FIGS. 7A and 7B.

Several of the parts described herein including the gate, the mount, the upright post assembly, rollers and cams can be made from a number of different types of material including metals, durable plastics, rubbers and the like. Such materials are commercially available. Materials now know or developed in the future can be used to make the various parts of the present invention.

In addition to the safety barrier described herein the present invention encompasses methods of using the safety barrier. For a lift platform on which the safety barrier of the present invention is installed, the steps of the methods include raising the lift platform. As described herein, when the lift platform is raised to the upper position, the safety gate automatically moves to a closed position. One or more workers can then load or unload any cargo onto or from a vehicle such as a truck because the lift platform will be relatively coplanar, level with or aligned with the cargo bed of the vehicle. The worker(s) can load or unload by moving to and from the truck side of lift platform (e.g., the opposite side of where the gate is mounted). The worker(s) can load or unload without fear of falling off the lift platform. Once the task is completed, the lift platform can be lowered to the bottom position and the gate is automatically moved to the open position. As the lift platform is lowered, the safety gate opens, allowing for cargo and/or workers to pass through the gate.

The present invention further includes kits and/or systems that include the components of the safety barrier described herein. For example, the kits or systems of the present invention include one or more gates having a cam surface, the mounting assembly (e.g., mount and pin), and the upright post assembly (e.g., the upright post and cam or roller assembly), as described herein.

As will now be apparent, a safety barrier for a loading dock lift constructed in accordance with this invention provides a safety gate that provides a barrier when the lift platform is elevated from the non-moving surface (e.g., fixed platform, ground, floor). Closing of the safety gate occurs automatically without effort by personnel while the lift platform is proximate its bottom position. Moreover, it will be apparent that such a safety gate is economical to install.

While this invention has been particularly shown and described with references to preferred embodiments thereof, it will be understood by those skilled in the art that various changes in form and details may be made therein without departing from the scope of the invention encompassed by the appended claims.

The terms, comprise, include, and/or plural forms of each are open ended and include the listed items and can include additional items that are not listed. The phrase "And/or" is open ended and includes one or more of the listed items and combinations of the listed items.

The relevant teachings of all the references, patents and/or patent applications cited herein are incorporated herein by reference in their entirety.

What is claimed is:

1. A safety barrier for a lift platform that moves between a bottom position and an upper position, said safety barrier comprises:

a) a gate, defining a first plane, comprising at least one or more members and a surface adapted to engage a cam assembly, wherein the gate, when in use, opens and closes in the first plane;

b) a mount that mounts to the lift platform, wherein the mount has a mounting pin that rotatably mounts the gate; wherein the mounting pin defines an axis and the gate rotates about the axis in the first plane;

c) an upright post assembly having an upright post mounted to a non-movable surface, and the cam assembly that applies an upward force to the surface of the gate;

wherein when the lift platform moves to the bottom position, the assembly engages the surface of the gate and the gate rotates about the axis in the first plane into an open position, and wherein when the lift platform moves to the upper position, the assembly engages the surface of the gate and the gate rotates about the axis in the first plane into a closed position, as the lift platform is moved between said bottom position and said upper position.

2. The safety barrier of claim 1, wherein linear motion exerted by the cam assembly onto the surface of the gate translates into rotational motion of the gate.

3. The safety barrier of claim 1, wherein during rotation of the gate, the cam assembly engages the surface of the gate along a length of the surface of the gate.

4. The safety barrier of claim 1, wherein the mounting pin is mounted to allow the gate to rotate in the first plane that transects a second plane defined by the surface of the gate.

5. The safety barrier of claim 1, wherein the gate further includes one or more crossbars, wherein the mounting pin is rotatably mounted to the one or more members or the one or more crossbars.

6. The safety barrier of claim 1, further comprising a spring having a first end attached to the mount and a second end attached to the gate.

7. A safety barrier for a lift platform that moves between a bottom position and an upper position, said safety barrier comprises:

a) a gate, defining a first plane, comprising at least one or more members, wherein the gate, when in use, opens and closes in the first plane; and a cam surface adapted to engage a cam assembly wherein the cam surface defines a second plane that transects the first plane;

b) a mount that mounts to the lift platform, wherein the mount has a mounting pin that rotatably mounts the gate; wherein the mounting pin defines an axis and the gate rotates about the axis in a first direction in the first plane and in a second direction in the first plane, wherein the second direction is opposite the first direction;

c) an upright post assembly having an upright post mounted to a non-movable surface, and the cam assembly that comprises a cam or roller;

wherein when the lift platform moves to the bottom position, the cam or roller engages the cam surface and the gate rotates in the first direction about the axis in the first plane into an open position, and wherein when the lift platform moves to the upper position, the cam or roller engages the cam surface of the gate and the gate rotates about the axis in the first plane in the second direction into a closed position, as the lift platform is moved between said bottom position and said upper position.

8. The safety barrier of claim 7, wherein linear motion exerted by the cam assembly onto the cam surface translates into rotational motion of the gate.

9. The safety barrier of claim 7, wherein during rotation of the gate, the cam assembly engages the cam surface along a length of the cam surface.

10. A safety barrier for a lift platform that moves between a bottom position and an upper position, said safety barrier comprises:

a) a gate having at least a first member and a second member extending between at least a first crossbar and a second crossbar; wherein the first member and the second member are essentially parallel and define a first plane; wherein the gate has a cam surface that defines a second plane that transects the first plane, and engages a cam or roller;

b) a mount having an upper portion and a lower portion; said upper portion comprises a mounting pin and the lower portion of the mount is secured to the lift platform; and the mounting pin rotatably mounts the gate to the upper portion of the mount; wherein the mounting pin defines an axis and the gate rotates about the axis in a first direction in the first plane and in a second direction in the first plane, wherein the second direction is opposite the first direction;

c) an upright post having an upper end and a lower end, said upper end of the upright post is configured to receive a cam assembly and said lower end of the upright post is mounted to a non-movable surface;

d) the cam assembly having a cam pin and the cam or roller, wherein the cam assembly is attached to the upper end of the upright post;

wherein when the lift platform moves to the bottom position, the cam or roller engages the cam surface and the gate rotates in the first direction about the axis in the first plane into an open position, and wherein when the lift platform moves to the upper position, the cam or roller engages the cam surface of the gate and the gate rotates about the axis in the first plane in the second direction into a closed position, as the lift platform is moved between said bottom position and said upper position.

11. The safety barrier of claim 10, wherein linear motion exerted by the cam assembly onto the cam surface translates into rotational motion of the gate.

12. The safety barrier of claim 10, wherein during rotation of the gate, the cam assembly engages the cam surface along a length of the cam surface.

13. The safety barrier of claim 10, wherein the mounting pin is rotatably mounted to the gate at the first crossbar, the second crossbar, the first member or the second member.

14. The safety barrier of claim 10, further comprising a spring having a first end attached to the mount and a second end attached to the gate.

* * * * *